United States Patent [19]

Creed et al.

[11] 4,278,037

[45] Jul. 14, 1981

[54] CHAIN STITCH CONVERSION FOR LOCK STITCH SEWING MACHINE

[75] Inventors: Gerald J. Creed, Rahway; Frank Dudis, Elizabeth; William J. Edwards, Cranbury; Herbert T. Hurler, Elizabeth, all of N.J.

[73] Assignee: The Singer Company, Stamford, Conn.

[21] Appl. No.: 75,445

[22] Filed: Sep. 14, 1979

[51] Int. Cl.[3] ..... D05B 1/14; D05B 57/04

[52] U.S. Cl. ..... 112/168; 112/202; 112/260

[58] Field of Search ..... 112/168, 184, 297, 202, 112/260

[56] References Cited

U.S. PATENT DOCUMENTS

| | | | |
|---|---|---|---|
| 1,290,048 | 1/1919 | Barron et al. | 112/197 |
| 1,549,328 | 8/1925 | Plumley | 112/197 |
| 3,173,390 | 3/1965 | Bartosz | 112/168 |
| 3,173,391 | 3/1965 | Doerner | 112/168 |
| 3,194,197 | 7/1965 | Ketterer et al. | 112/168 |
| 3,253,560 | 5/1966 | Ketterer et al. | 112/168 |
| 3,513,795 | 5/1970 | Hagemeyer | 112/260 |
| 3,720,178 | 3/1973 | Ivanko | 112/168 |
| 3,908,569 | 9/1975 | Ketterer | 112/197 |
| 4,194,456 | 3/1980 | Edwards et al. | 112/168 X |

*Primary Examiner*—Wm. Carter Reynolds

*Attorney, Agent, or Firm*—Edward P. Schmidt; Robert E. Smith; Edward L. Bell

[57] ABSTRACT

A chain stitch conversion throat plate for a lock stitch sewing machine, the throat plate carrying a thread loop retaining pin and a thread stripper device actuated by the up and down motion of the sewing machine feed dog. The thread stripper device includes a block pivotably supporting a wire form having one end for extending beneath the feed dog for up and down motion therewith, and the other end extending adjacent the thread loop retaining pin for stripping the retained loop therefrom on downward motion of the feed dog.

1 Claim, 9 Drawing Figures

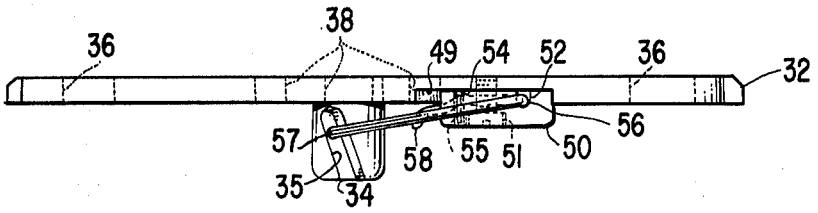
Fig. 2
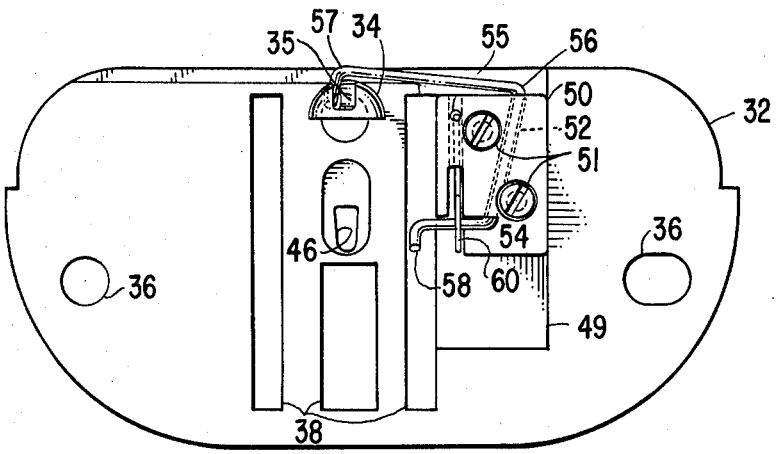
Fig.3
Fig.4
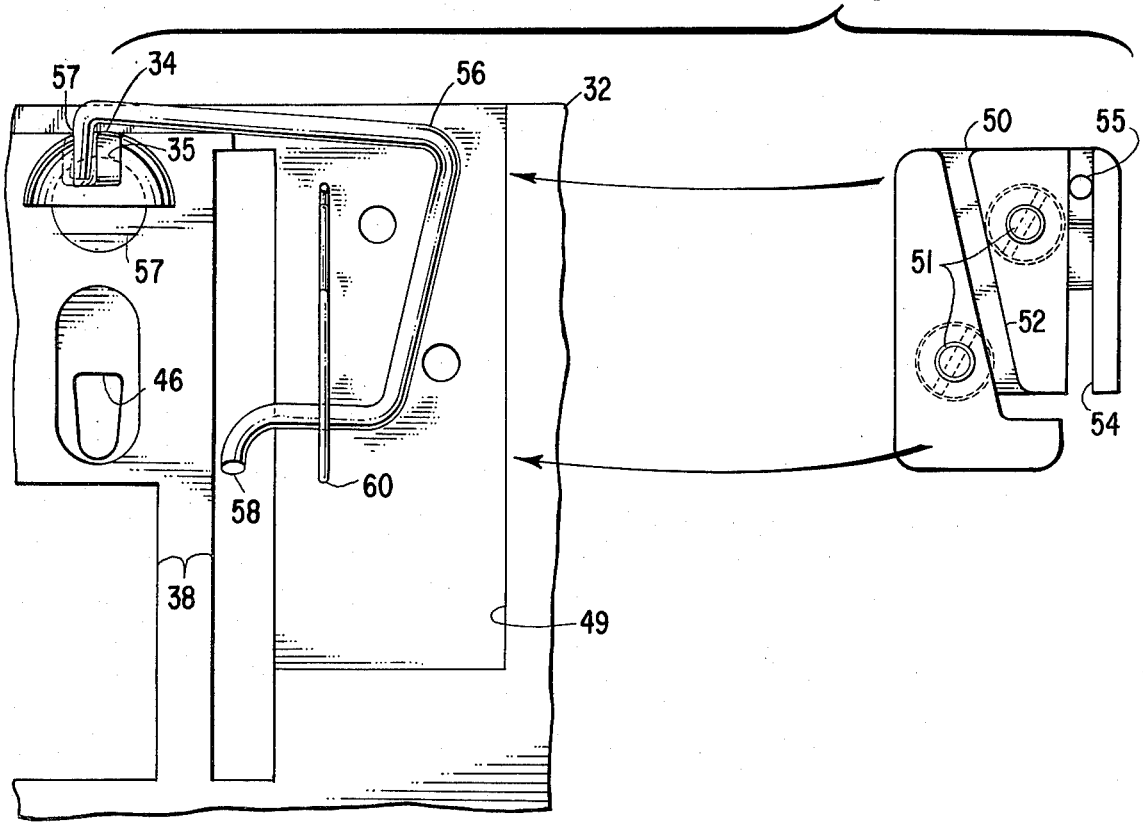

CHAIN STITCH CONVERSION FOR LOCK STITCH SEWING MACHINE

BACKGROUND OF THE INVENTION

This invention is in the field of sewing machines, more particularly, it is concerned with a conversion device permitting the conversion of a lock stitch sewing machine to the production of chain stitches.

There are in the prior art, many examples of chain stitch devices for lock stitch sewing machines. There are, for example, the devices disclosed by U.S. Pat. Nos. 3,173,390 and 3,173,391 issued on Mar. 16, 1965 to, respectively, Bartosz and Doerner. These two patents disclose the use of leaf springs to retain the prior thread loop until the sewing needle has stepped therethrough on its way to having a new thread loop seized by the loop taker.

There is also U.S. Pat. No. 3,194,197, issued on July 13, 1965 to Ketterer et al, which patent discloses a lever pivotally connected to the throat plate and having a loop retaining finger with an opening therethrough which may engage with a finger extending from a plate supported in the bobbin case to retain a loop on the loop retaining finger when the lever is urged by a thread pull off to maintain intimate contact between the thread engaging finger and the plate in the bobbin case.

U.S. Pat. No. 3,253,560, issued on May 31, 1966 to Ketterer et al and U.S. Pat. No. 3,720,178 issued on Mar. 13, 1973 to Ivanko disclose inserts for a bobbin case which are rockable or have a portion thereof rockable in order to, at first, retain a thread loop and subsequently release the loop of thread after the sewing needle has passed therethrough.

It frequently occurs that an advance in the art prevents the use of heretofore known devices such as the aforementioned chain stitch conversion devices. Thus, the development of a new anti-rotation device for the bobbin case, which device is located adjacent and in front of the sewing needle, required the development of a new chain stitch conversion device compatible for use therewith.

SUMMARY OF THE INVENTION

The new chain stitch conversion device utilizes a replacement throat plate for chain stitching, differing from the usual throat plate in having an enlarged aperture through which the needle penetrates, a depending thread retaining pin on which the loop cast off by the loop taker may be retained until the sewing needle has stepped therethrough, and a block supporting a wire form having an arm extending to the depending pin and a second arm extending beneath a feed dog together with a spring urging the wire form in engagement with the bottom of the feed dog. Thus, when the feed dog is lowered to beneath the throat plate and the sewing needle penetrates the work material and a loop retained on the depending pin, the retained loop will be stripped from the depending pin so that the slack therein may be taken up by the take-up lever. An insert is provided for the bobbin case, the insert having an aperture at one end for receiving the depending pin, the insert operating to initially guide the thread onto the pin by maintaining the loop shed by the looptaker in an elevated position.

BRIEF DESCRIPTION OF THE DRAWINGS

The accompanying drawings illustrate a preferred embodiment of the invention in which:

FIG. 2 is a front elevational view of the throat plate illustrated in FIG. 1;

FIG. 3 is a bottom plan view of the throat plate of FIG. 2;

FIG. 4 is a disassembled bottom plan view of a portion of the throat plate shown in FIG. 3;

Referring to FIG. 1, there is shown a conventional lock stitch sewing machine 10 having a frame including a bed portion 12 thereof partially cut away in order to show details thereof. There is visible on the back surface of the sewing machine 10 an upper thread supply 14 and pretension device 16 which guides the thread into a slot extending over the top of the sewing machine and into a tension device (not shown). Thereafter, the thread goes about a pivot point (not shown) and onto a thread take-up lever which is also not shown, however, these cited devices are well known in the sewing machine art. Thereafter the thread extends downwardly through a thread guide 18 on a needle bar 20 supported for endwise reciprocation and lateral oscillation in the head of the sewing machine as is well known in the sewing machine art. The thread extends downwardly through the eye of a sewing needle 22 affixed to the needle bar 20 in order to undergo endwise reciprocation with the needle bar so that the sewing needle may operate in synchronism with a loop taker 24 in the formation of stitches. The loop taker 24 is driven in synchronism with the endwise reciprocation of the needle bar 20 by the main drive (not shown) of the sewing machine 10 by means of miter gears 26 connected to the shaft 25 of the loop taker. The loop taker 24 is shaped roughly as a shallow cup and supports internally thereof a bobbin supporting case 28, which bobbin case is stopped from rotation with the loop taker by a bridge device 30 extending about an upstanding lug 29 of the bobbin case 28 (see also FIGS. 5–8), which bridge device is fastened to the sewing bed portion 12 by screws 31, only one of which is visible in FIG. 5. The presence of this upstanding lug 29 of the bobbin case 28, and the bridge device 30 encircling the lug, prevents the use of many of the heretofore known chain stitch conversion devices for lock stitch sewing machines as interferring with the placement and operations thereof. Accordingly, this invention was developed in order to permit the conversion from lock stitch to a chain stitch which would be compatible with the new rotation restraining bridge device 30 for the bobbin case 28.

In a chain stitch conversion device, some means must be provided for retaining the prior loop against the action of the sewing machine take-up lever until such time as the succeeding needle penetration has passed through this loop. Thereafter, the retained loop may be shed while the new loop is being formed for subsequent retention. The retained loop must extend through a needle aperture 46 to a work fabric being advanced through the sewing machine 10 in a fashion that permits each succeeding needle penetration to extend through the retained loop. The loop retainer must therefore be situated upstream of the path of the needle reciprocation with respect to the direction of work fabric advancement by the work feeding system, in order to retain a thread loop which the sewing needle can step through in a subsequent stitch. Thus, there is illustrated in FIGS. 2, 3 and 4, a throat plate 32 which may accomplish the chain stitch conversion with only the addition of a filler plate in the bobbin case to take the place of the bobbin normally used during lock stitch sewing in order to insure retention of the loop. Referring to FIG. 2, the throat plate 32 is fashioned with a depending pin 34 extending from the bottom side thereof, for retaining a thread loop as will be explained below the depending pin being tapered downwardly in order to facilitate thread removal therefrom. The depending pin 34 is fashioned with a groove 35 (see also FIG. 3) somewhat inclined from the vertical. Referring to FIG. 3, it is seen that the throat plate is fashioned with apertures 36 to receive the posts of magnets (not shown) supported in the bed of the sewing machine, which magnets would retain the throat plate in position during operation of the sewing machine. There are further, elongated openings 38 to accommodate the extension of a feed dog 39 (see FIGS. 1 and 6 through 8), part of the usual sewing machine feeding system, through the throat plate 32 to feed the work material trapped between the feed dog and a presser foot 40 carried on the end of a presser bar 42 which is slidingly supported in a bushing 44 affixed in the head of a sewing machine 10 (see FIG. 1). The presser bar 42 is urged in a manner well known in the sewing machine art and supported within the head of the sewing machine 10 to press the presser foot 40 against the work material in opposition to the upward thrust of the feed dog 39 during feeding of the work material. Returning to FIG. 3, there is shown situated between the depending pin 34 and the feed dog slots 38 an aperture 46 through which the needle 22 may extend, which aperture is elongated in the direction of feed.

Figure 1:
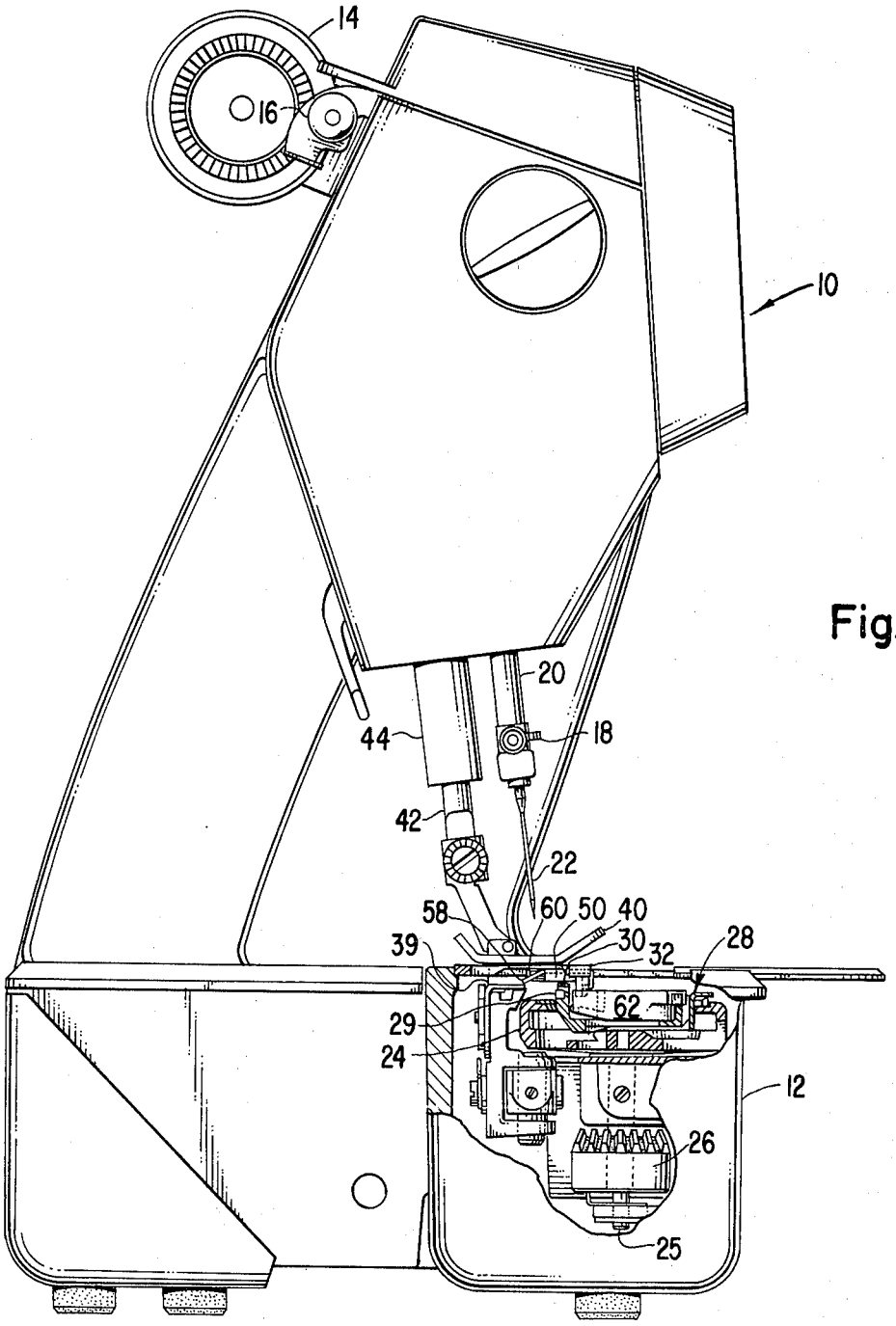
FIG. 1 represents a head end elevational view of a sewing machine having a chain stitch conversion device in accordance with this invention applied thereto and with the bed partially broken away to expose the mechanism therein.

Adjacent the feed dog slots 38 a trench 49 is cut in the throat plate 32 to accommodate a block 50, part of a thread stripper device 48 which block is attached to the throat plate by screws 51. By reference to FIG. 4 it may be seen that the underside of the block 50 is grooved 52 diagonally from the top of the block to adjacent the bottom edge where the groove turns abruptly and extends out the side of the block. The groove 52 of the block 50 is filled with a wire form 56, a first end 57 of which extends into the groove 35 of the depending pin 34, the second end 58 extending to lie beneath the adjacent feed dog slot 38. The block 50 is fashioned with a further lengthwise groove 54, which partially extends through the block, the lengthwise groove having an aperture 55 extending from the groove to the opposite side of the block. A spring 60 extends through the aperture 55 and along the lengthwise groove 54 on the opposite side of the second end 58 of the wire form 56 from the throat plate, and constantly urges the end 58 upwardly towards the throat plate. When the throat plate 32 is installed on the sewing machine, the leg of the feed dog 39 which is closely adjacent the block 50 is arranged to extend above the leg 58 of the wire form 56 so that motion of the feed dog moving downwardly during needle penetration will cause the leg 57 of the wire form to strip a retained loop from the depending pin 34; and motion of the feed dog upwardly will be followed by the second end 58 of the wire from 56 due to the urgings of the spring 60. Thus, the throat plate 32 supports thereon a stationary thread loop retaining pin 34 and thread stripper device 49 to remove the retained loop from the pin.

Figure 5:
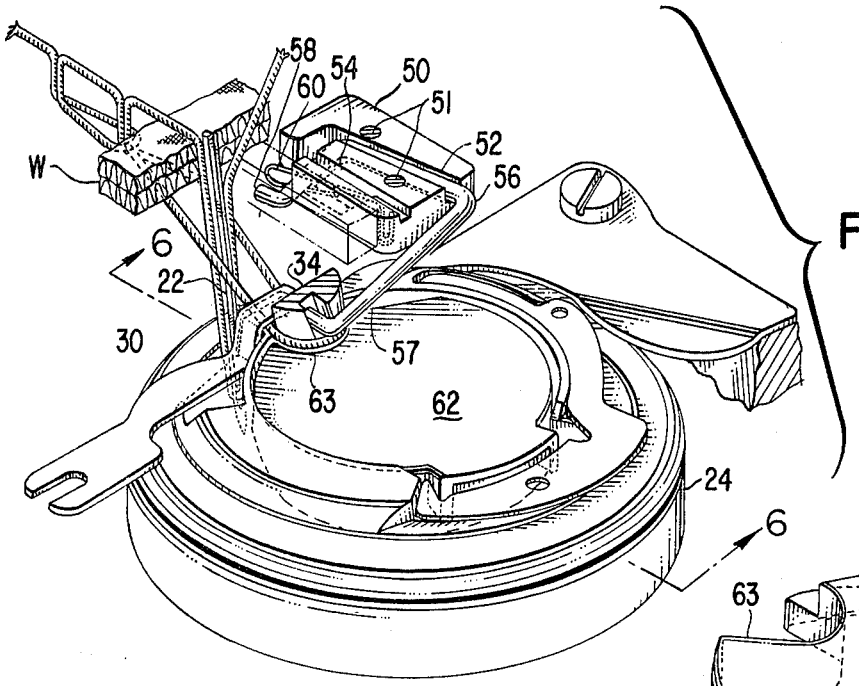
FIG. 5 is a perspective view of a portion of the stitch forming instrumentalities with the chain stitch conversion device of FIG. 1, showing the disposition of parts and thread as the needle penetrates the work.
Figure 5A:
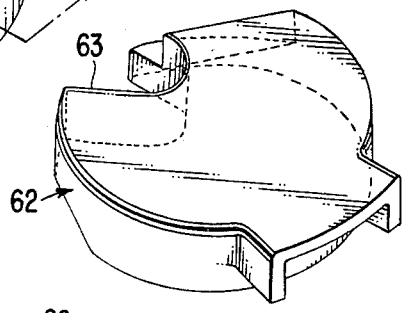
FIG. 5*a* is a perspective view of the insert to the bobbin case shown in FIG. 5.

Referring now to FIG. 5, there is shown a perspective view of fragments of the stitch forming instrumentalities of the sewing machine including the depending pin 34 and the block 50 both of which are attached to the throat plate 32. The throat plate 32, however, is not shown so that the relationship of these elements to the stitch may be more apparent. Thus, the sewing needle 22 is shown extending through a work material W and through a loop of the prior stitch retained on depending pin 34. The depending pin should be of sufficient width to insure that the sewing needle 22 will step through the retained loop without fraying or piercing the thread thereof. The end 57 of the wire form 56 extends into the groove 35 of the depending pin 34 above the loop retained thereon. The end 58 of the wire form 56 extending beneath one leg of feed dog 39 has been moved an insufficient distance by the feed dog to cause the end 57 of the wire form to strip the loop from the depending pin 34. The loop taker 24 carries therein the bobbin case 28, and set within the bobbin case is an insert 62, a separate perspective view of which is shown in FIG. 5*a*. The insert 62 serves as a filler plate to take the place of the bobbin normally present in the bobbin case 28 during lock stitch sewing, and provides a relief 63 into which the depending pin 34 attached to the throat plate 32 may extend. The insert 62 serves to direct the loop shed by the loop taker 24 to the depending pin 32, and eliminates the possibility of skipped stitches due to the shed loop avoiding the depending pin.

Figure 6:
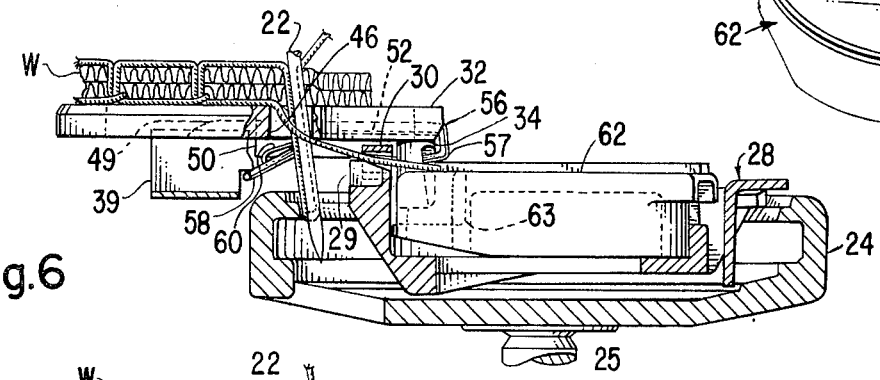
FIG. 6 is a cross sectional view of the stitch forming instrumentalities taken substantially along line 6—6 of FIG. 5 showing the disposition of parts and thread as the needle penetrates the work.
Figure 7:
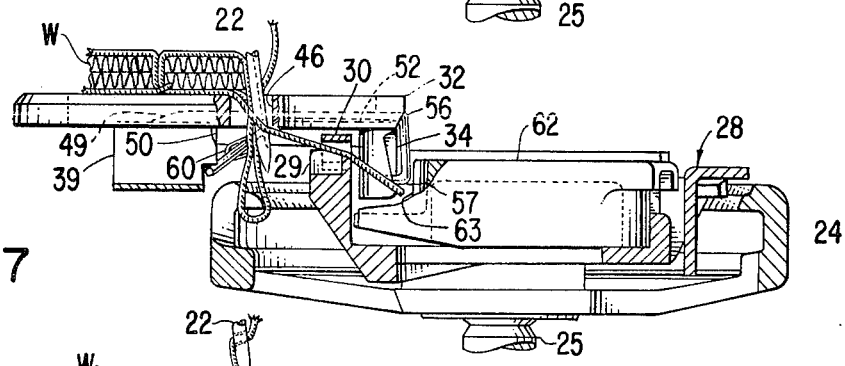
FIG. 7 is a cross sectional view of the stitch forming instrumentalities similar to FIG. 6 but showing the disposition of parts and thread as the hook point takes the needle loop and as the retained needle loop is stripped from the post depending from the throat plate; and, FIG. 8 is a cross sectional view of the stitch forming instrumentalities similar to FIGS. 6 and 7 but showing the disposition of parts and thread as the needle emerges from the work after loop seizure.
Figure 8:
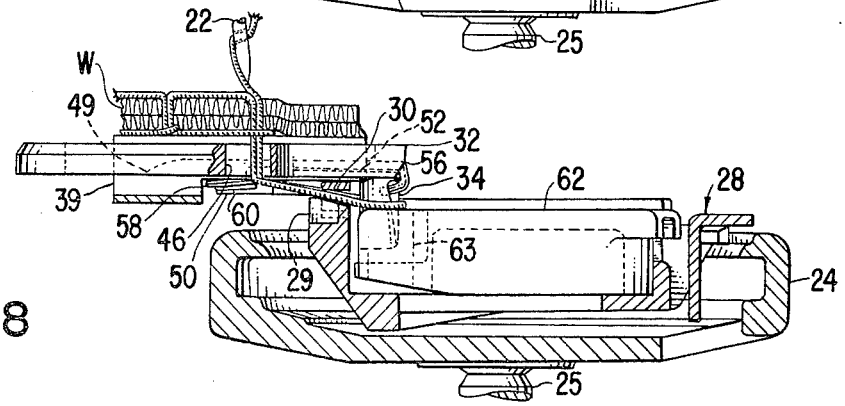

In FIG. 6, there is shown a cross sectional view of the loop taker 24, bobbin case 28, insert 62 and work material W above the throat plate 32 when those components are in a position corresponding to that shown in FIG. 5. The feed dog 39 has descended below the throat plate 32 to discontinue feeding while the needle 22 is in the work material W. The sewing needle 22 has stepped through the loop retained on the depending pin 34; however, the needle has not cast its own loop to be picked up by the loop taker 24. Referring to FIG. 7, it is apparent that the needle loop has been picked up by the loop taker 24 and that the needle 22 has begun withdrawal from the work material W. The feed dog 39 has further operated upon the end 58 of the wire form 56 to cause the first end 57 thereof to urge the retained loop from the depending pin 34. FIG. 8 discloses the situation when the sewing needle 22 has been removed from the work material W, and the new loop has been shed by the loop taker 24 to be retained on the depending pin 34 of the throat plate 32. The feed dog 39 is moving to an elevated work feeding position and the wire form 56 is urged by its spring 60 into a position following the feed dog and out of contact with the retained loop on the depending pin 34.

Though not heretofore mentioned, it will be appreciated by those skilled in the art that the thread capacity of the take-up mechanism needs to be reduced by some means for removing thread supply from the threading systems, due to the retained thread loop. This may most usually be accomplished by utilizing a second thread eyelet in the take-up lever which swings about a shorter arc, thereby giving up or taking up less thread. When chain stitching is first initiated, an initial quantity of thread equivalent to that used for the retained loop is taken through the tension. In subsequent stitches, there being insufficient thread to enlarge the loops taken by the loop taker about the bobbin case, additional thread will be taken from the retained loop and the parts and thread will have assummed the position illustrated in FIG. 8. The setting of the stitch occurs approximately at the top of the needle stroke, when the thread demanded by the take-up lever must reeve around the depending pin 34 to further tighten the stitch just prior to the retained loop against the work material W.

Thus has been disclosed a chain stitch conversion device for a lock stitch sewing machine which is supported almost entirely on the throat plate. Additionally, there is provided an insert 62 to replace the bobbin in the bobbin case 28 in order to insure non-interference with the loop released by the loop taker 24 as well as to provide an aperture 63 for the depending pin 34 extending into that aperture from the throat plate 32. Although the invention has been described in its preferred form and with a certain degree of particularity, it is understood that the present disclosure of the preferred form has been made by way of example and that numerous changes in the details of construction and the combination and arrangement of parts may be resorted to without departing from the spirit and the scope of the invention.

We claim:

1. In a sewing machine having lockstitch forming instrumentalities including a frame having a work support, a throat plate supported in said work support, said throat plate having a needle aperture, a thread carrying eye pointed needle supported above said throat plate for endwise reciprocation through said needle aperture, a circularly moving looptaker carried below said throat plate on an axis substantially parallel to the path of endwise reciprocation of said needle, means for driving said needle and looptaker in timed relation for a seizure of a loop of thread from the eye of the needle bar by said looptaker during each stroke of the needle downwardly through said needle aperture and release of said seized loop by said looptaker during each succeeding upward stroke of the needle, a bobbin supporting case journalled in said looptaker and constrained from circular movement with said looptaker by stop means sustained on said frame, and a linear work feeding mechanism effective to advance work fabric on said work support in one direction from said needle aperture between each needle penetration thereof, said work feeding mechanism including a feed dog rising to an operative position through a slot in said throat plate when said upward stroke of said needle removes said needle from said work fabric and descending through said slot in said throat plate when said needle extends downwardly through said work material, means for sewing chain stitches using thread carried by said needle comprising a stationary thread loop retaining pin carried by said throat plate and having a free extremity, said retaining pin extending in a direction from said throat plate substantially parallel to said path of endwise needle reciprocation and arranged upstream of said path of needle reciprocation with respect to the advancement of work fabric by said work feeding mechanism, said retaining pin having a groove extending substantially from said throat plate to said free extremity, a thread stripper device supported by said throat plate adjacent said feed dog accommodating slot, said stripper device including a wire form with a first end extending into said groove of said thread loop retaining pin and with a second end extending beneath said feed dog for up and down movement thereby, resilient means for urging said wire form against said feed dog, and means on said throat plate for supporting pivotal movement of said wire form; and an insert for said bobbin supporting case to take the place of the bobbin supported therein during lockstitch sewing, said insert having an aperture in an edge thereof close by said needle for receiving a lower extremity of said thread loop retaining pin, whereby when said needle has extended through a loop from the prior stitch retained on said loop retaining pin and released the loop of thread to said loop-taker, said thread stripper element will have been urged by said feed dog to strip the retained loop from the thread loop retaining pin.

* * * * *